US006682073B2

(12) United States Patent
Bryant et al.

(10) Patent No.: US 6,682,073 B2
(45) Date of Patent: Jan. 27, 2004

(54) GAMING MACHINE WITH TOOL FEATURE

(75) Inventors: Natalie Bryant, Lane Cove (AU); Philippa Graham, Lane Cove (AU); Christopher Stevens, Lane Cove (AU)

(73) Assignee: Aristocrat Technologies Australia PTY Ltd., Lane Cove (AU)

( * ) Notice: Subject to any disclaimer, the term of this patent is extended or adjusted under 35 U.S.C. 154(b) by 0 days.

(21) Appl. No.: 10/072,787

(22) Filed: Feb. 6, 2002

(65) Prior Publication Data

US 2002/0175464 A1 Nov. 28, 2002

(30) Foreign Application Priority Data

Feb. 7, 2001 (AU) ..... PR 2942

(51) Int. Cl.[7] ..... A63B 71/00

(52) U.S. Cl. ..... 273/138.1; 273/274; 273/292; 273/309; 273/143 R; 463/13; 463/19; 463/20; 463/21

(58) Field of Search ..... 273/138.1, 292, 273/274, 309, 143 R, 269; 463/13, 19, 20, 21; 473/12, 27

(56) References Cited

U.S. PATENT DOCUMENTS 5,836,586 A * 11/1998 Marks et al. ..... 273/292
5,853,325 A * 12/1998 Kadlic ..... 463/13
6,089,977 A * 7/2000 Bennett ..... 463/20
6,113,102 A * 9/2000 Marks et al. ..... 273/292
6,120,378 A * 9/2000 Moody et al. ..... 463/20
6,159,095 A * 12/2000 Frohm et al. ..... 463/19
6,159,098 A * 12/2000 Slomiany et al. ..... 463/25
6,203,429 B1 * 3/2001 Demar et al. ..... 463/20
6,234,897 B1 * 5/2001 Frohm et al. ..... 463/20
6,261,177 B1 * 7/2001 Bennett ..... 463/16
6,311,976 B1 * 11/2001 Yoseloff et al. ..... 273/138.2
6,315,660 B1 * 11/2001 DeMar et al. ..... 463/16
6,347,996 B1 * 2/2002 Gilmore et al. ..... 463/17
6,364,766 B1 * 4/2002 Anderson et al. ..... 463/16
6,443,837 B1 * 9/2002 Jaffe et al. ..... 463/16
6,454,266 B1 * 9/2002 Breeding et al. ..... 273/292
6,482,089 B2 * 11/2002 DeMar et al. ..... 463/20
6,505,117 B1 * 1/2003 Ratert et al. ..... 701/209
6,508,707 B2 * 1/2003 DeMar et al. ..... 463/16
6,517,432 B1 * 2/2003 Jaffe ..... 463/16
6,520,855 B2 * 2/2003 DeMar et al. ..... 463/20

OTHER PUBLICATIONS

Lara Croft Tomb Raider Web Page, http://shopping.yahoo.com/shop?d=zvgm&id=1951008664&clink=dmks/Tomb_Raider.

* cited by examiner

*Primary Examiner*—Benjamin H. Layno
*Assistant Examiner*—Dolores R Collins
(74) *Attorney, Agent, or Firm*—Knobbe, Martens, Olson & Bear, LLP

(57) ABSTRACT

A gaming machine having a display and a game controller arranged to control images displayed on the display. The game controller is arranged to play a game wherein at least one random event is caused to be displayed on the display and, if a predefined winning event occurs, the machine awards a prize. A game played under the control of the controller includes aid symbols, the aid symbols being applied in a subsequent game feature to improve the player's prospects of success in the subsequent feature.

19 Claims, 14 Drawing Sheets

GAMING MACHINE WITH TOOL FEATURE

RELATED APPLICATIONS

This application claims priority to the Australian application PR2942 filed Feb. 7, 2001 entitled "GAMING MACHINE WITH TOOL FEATURE" and is related to U.S. application Ser. No. 10/0 13594 incorporated herein by reference.

FIELD OF THE INVENTION

This invention relates to a gaming machine. More particularly, the invention relates to a gaming machine and to an improvement to a game played on such a gaming machine.

BACKGROUND TO THE INVENTION

Players who regularly play gaming machines quickly tire of particular games and therefore it is necessary for manufacturers of these machines to develop innovative game features which add interest to the games. In so doing, it is hoped to keep players amused and therefore willing to continue playing the game as well as to attract new players.

Also, with the growth that has occurred in the gaming machine market, there is intense competition between manufacturers to supply various existing and new venues. When selecting a supplier of gaming machines, the operator of a venue will often pay close attention to the popularity of various games with their patrons. Therefore, gaming machine manufacturers are keen to devise games which are popular with the players as a mechanism for improving sales, retaining customers and attracting new customers.

SUMMARY OF THE INVENTION

According to the invention, there is provided a gaming machine having a display means and a game control means arranged to control images displayed on the display means, the game control means being arranged to play a game wherein at least one random event is caused to be displayed on the display means and, if a predefined winning event occurs, the machine awards a prize, the gaming machine being characterized in that a game played under the control of the control means includes symbols representative of aids (referred to below as "aid symbols"), said aid symbols being applied in a subsequent feature to improve the player's prospects of success in the subsequent feature.

In this specification, the term "applied" means, unless the context clearly indicates otherwise, using, accumulating, selling, swapping, or the like.

The game played under the control of the control means may be a base game with the subsequent feature being a feature game.

The aid symbols may be accumulated by the player during the base game, the aid symbols being used by the player in the subsequent feature. The aim of the aid symbols is to enable the player, in the subsequent feature game, to vary his or her position, ie. generally to increase the total number of credits received, during the feature game.

In one embodiment of the invention, the accumulation or collection of the aid symbols may be effected during the base game. Further, the accumulation of a predetermined number of the aid symbols during the base game may serve as a trigger condition for the subsequent feature game which may be a second screen feature game. In other words, once a certain number of aid symbols have been collected, the feature may commence. More aid symbols may be available than are needed to be collected to start the feature. Accordingly, the player will always enter the feature with the same number of aid symbols but the aid symbols themselves may differ from feature to feature. It will be appreciated that, preferably, various aid symbols are provided as a subset of symbols. Accordingly, it may require a predetermined number of different aid symbols to commence the second screen feature or some of the aid symbols may be the same as one another.

In another embodiment of the invention, after completion of the game, the subsequent feature commences during which the player may use the aid symbols that were accumulated during the game to improve the possibility of the player receiving a greater total monetary reward during the subsequent feature than would have been possible without the assistance of the aid symbols.

The game may be a series of free games triggered from a preceding game. During the series of free games, the aid symbols may be accumulated.

Still further, in another embodiment of the invention, the aid symbols may not need to be accumulated from the base game or a series of free games at all. Instead, the game may be a feature game during which at least one aid symbol is selected from a larger set of aid symbols. The selected aid symbols may be used during the subsequent feature. The subsequent feature may be a free game feature and the selected aid symbols may interact with other symbols of games of the free game feature.

In a variation of this embodiment, only those aid symbols that were displayed on the display means at the time when the feature was triggered may be available during the feature. In this regard, the feature may be triggered by a specific combination of symbols in a preceding game or by a random event of some sort which may be dependent upon the size of the player's bet.

In yet another embodiment of the invention, the subsequent game, being a secondary feature, may be run at the same time as the base game with aid symbols being collected from the secondary feature. This may be effected, for example, by means of a secondary display such as a top box monitor which may display the aid symbols at the same time as the base game is played. Every time the player makes a bet on the base game, a secondary animation may occur in the secondary display from which an aid symbol may or may not be revealed. Every time an aid symbol is revealed it will be accumulated either on the secondary display or on the primary display, unless it had already been collected, for use in a subsequent feature game.

The game played under the control of the control means may also include impediment symbols which have a negative effect on the success of the player. In such circumstances, the probability of success may be lowered or the effect of all aid symbols collected by the player may be nullified when the impediment symbol is revealed.

The aid symbols may, in certain circumstances only comprise a portion of a device representing an aid, the player having to collect the various portions of the device in order to have the benefit of the aid in a subsequent feature.

In still another embodiment, additional aid symbols may be accumulated during the feature using aid symbols that have already been accumulated. In addition, the aid symbols may only be used once during the feature or they may be able to be used more than once.

The player may be given the option to exchange aid symbols for at least one of other aid symbols and credits. For example, before a second screen feature commences, a trading feature may be commenced which allows the player to trade the player's accumulated aid symbols, either for other aid symbols or credits. The number of credits obtained and the value of each aid symbol may be different depending on the benefit afforded to the player by having that aid symbol in the second screen feature game.

Prizes that are awarded during the subsequent game employing the aid symbols may be dependent upon the aid symbols that were used to reveal them. Thus, the more difficult it is to reveal the prize, the higher the prize will be. Accordingly, as aid symbols are used to increase the likelihood of revealing the prize the value of the prize may be reduced proportionately. In such a way, the player may affect the volatility of the feature through use of the aid symbols.

The selection of the aid symbols may be randomly effected. Instead, player choice may be involved in selecting the aid symbols which the player wishes to use. to add interest and variety to the subsequent game or to increase the player's chances of success during the further feature.

BRIEF DESCRIPTION OF THE DRAWINGS

The invention is now described by way of example with reference to the accompanying diagrammatic drawings in which.

DETAILED DESCRIPTION OF THE DRAWINGS

Figure 1:
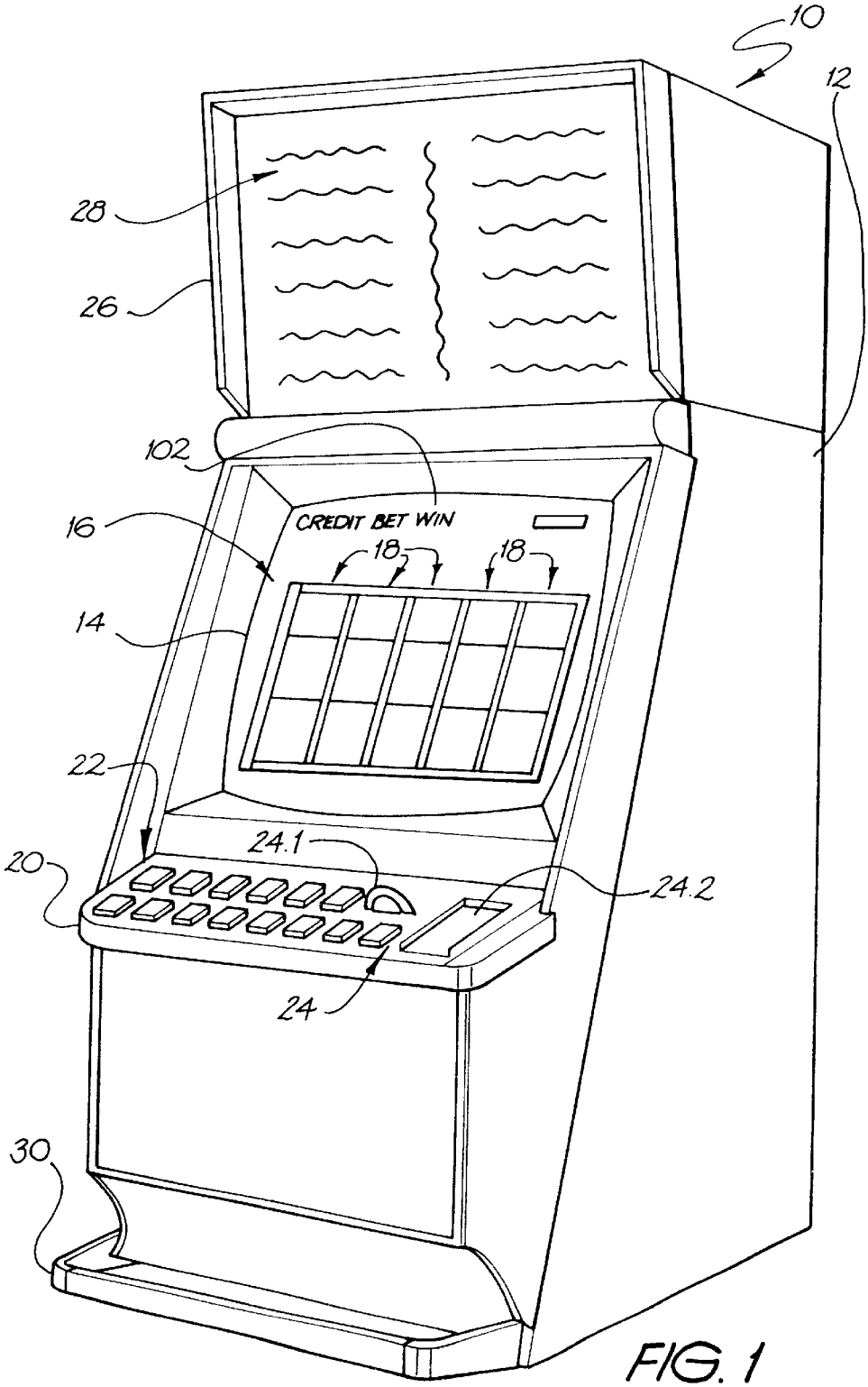
FIG. 1 shows a three dimensional view of a gaming machine, in accordance with the invention.

In FIG. 1, reference numeral 10 generally designates a gaming machine, including a game, in accordance with the invention. The machine 10 includes a console 12 having a video display unit 14 on which a game 16 is played, in use. The game 16 is a spinning reel game which simulates the rotation of a number of spinning reels 18. A midtrim 20 of the machine 10 houses a bank 22 of buttons for enabling a player to play the game 16. The midtrim 20 also houses a credit input mechanism 24 including a coin input chute 24.1 and a bill collector 24.2.

The machine 10 includes a top box 26 on which artwork 28 is carried. The artwork 28 includes paytables, details of bonus awards, etc.

A coin tray 30 is mounted beneath the console 12 for cash payouts from the machine 10.

Figure 2:
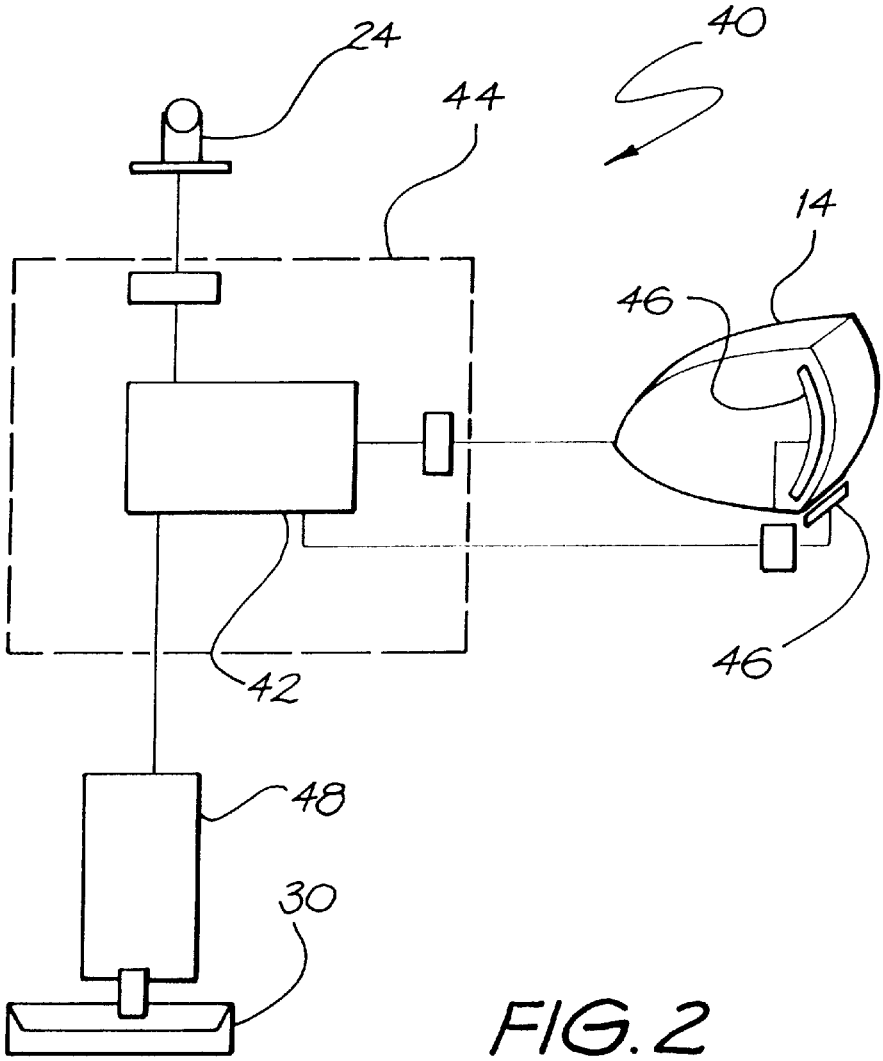
FIG. 2 shows a block diagram of a control circuit of the gaming machine.

Referring now to FIG. 2 of the drawings, a control means or control circuit 40 is illustrated. A program which implements the game and user interface is run on a processor 42 of the control circuit 40. The processor 42 forms part of a controller 44 which drives the screen of the video display unit 14 and which receives input signals from sensors 46. The sensors 46 include sensors associated with the bank 22 of buttons and touch sensors mounted in the screen. The controller 44 also receives input pulses from the mechanism 24 to determine whether or not a player has provided sufficient credit to commence playing. The mechanism 24 may, instead of the coin input chute 24.1 or the bill collector 24.2, or in addition thereto, be a credit card reader (not shown) or any other type of validation device.

Finally, the controller 44 drives a payout mechanism 48 which, for example, may be a coin hopper for feeding coins to the coin tray 30 to make a pay out to a player when the player wishes to redeem his or her credit.

Referring to FIGS. 3 and 4 of the drawings, a first embodiment of a game played on the gaming machine 10 is illustrated.

Figure 3A:
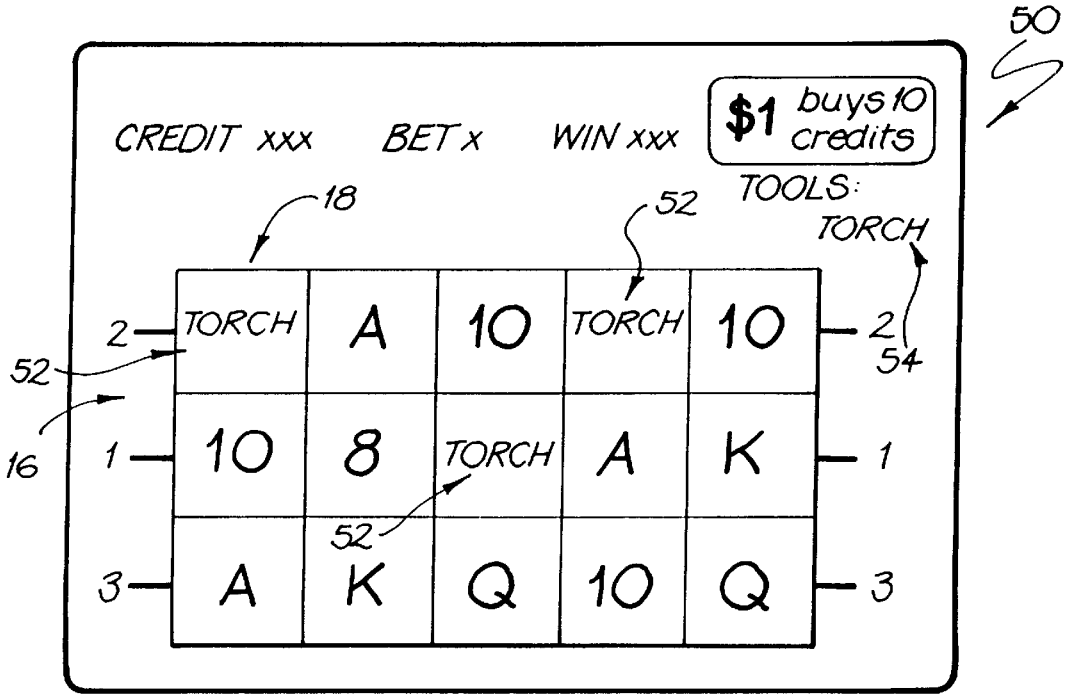
FIGS. 3*a* to 3*c* show a sequence of screen displays of a base game, in accordance with a first embodiment of the invention, played on the gaming machine of FIG. 1.

In FIG. 3*a*, a screen display 50 of a base game 16 is illustrated. The base game 16 is a spinning reel game. The reels of the game 16 include special symbols or aid symbols such as a Torch, Shovel, Food, Pickaxe and Matches symbols. During the base game 16, whenever three or more of the same aid symbols are spun up in a combination on the reels 18, that aid symbol is collected.

Accordingly, as shown in FIG. 3*a* of the drawings three aid symbols in the form of Torch symbols 52 are spun up. The symbol 52 is collected and is displayed at 54 on the screen display 50.

Figure 3B:
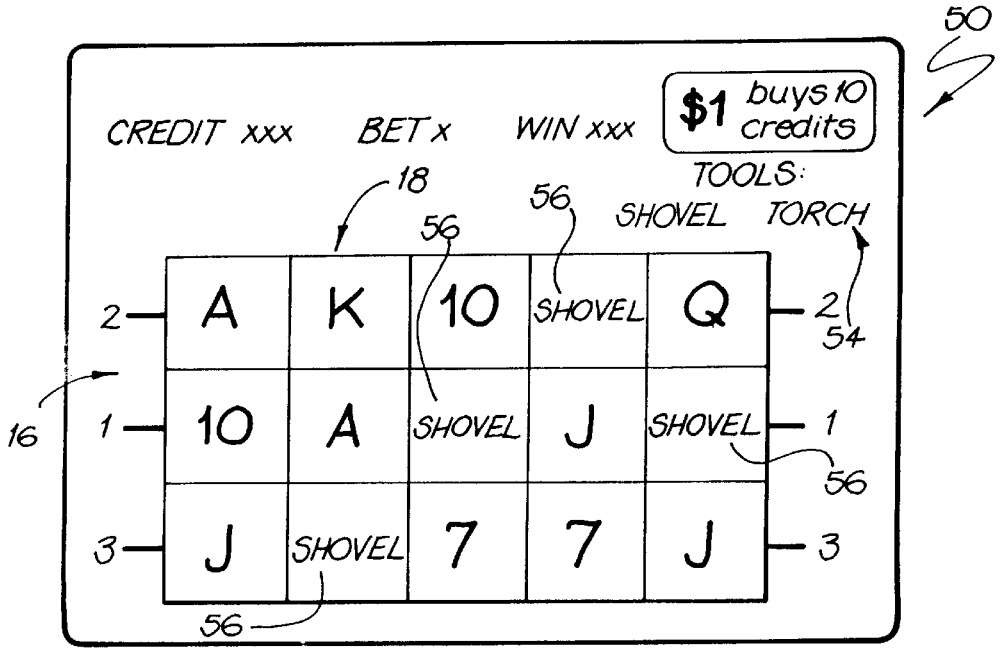

In FIG. 3*b* of the drawings, four Shovel symbols 56 are spun up. As more than three were spun up, the Shovel symbol 56 is also collected and is displayed at 54 on the screen display 50.

Figure 3C:
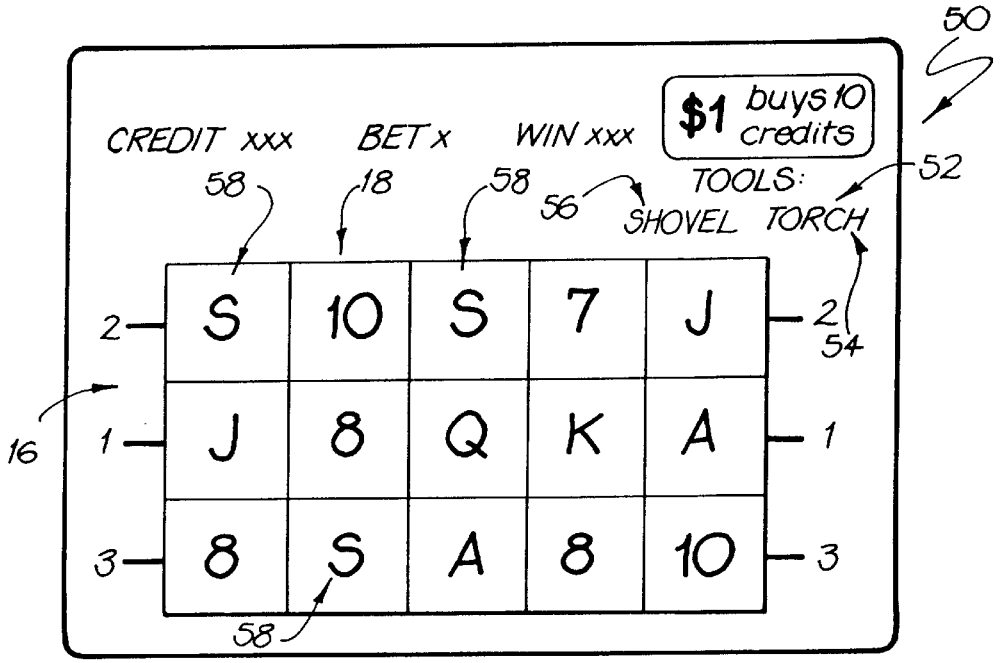

Whenever three scatter symbols (S) 58, as shown in FIG. 3*c*, are spun up, a second screen feature is triggered.

Figure 4A:
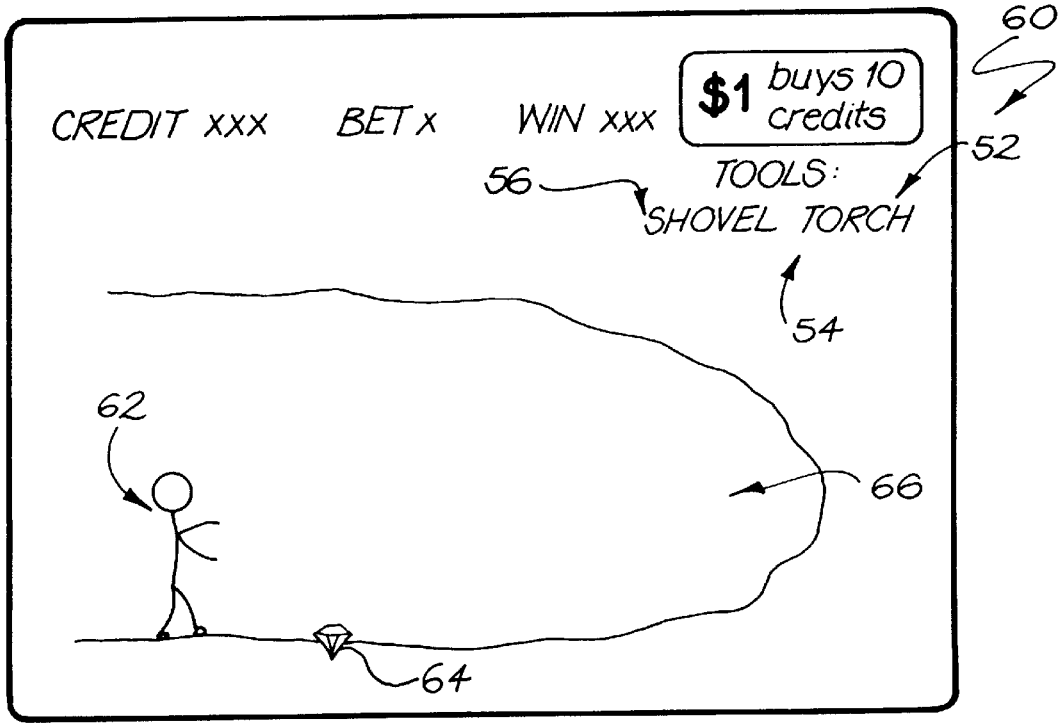
FIGS. 4*a* to 4*c* show various screen displays of a second screen feature following on from the game of FIG. 3.
Figure 4B:
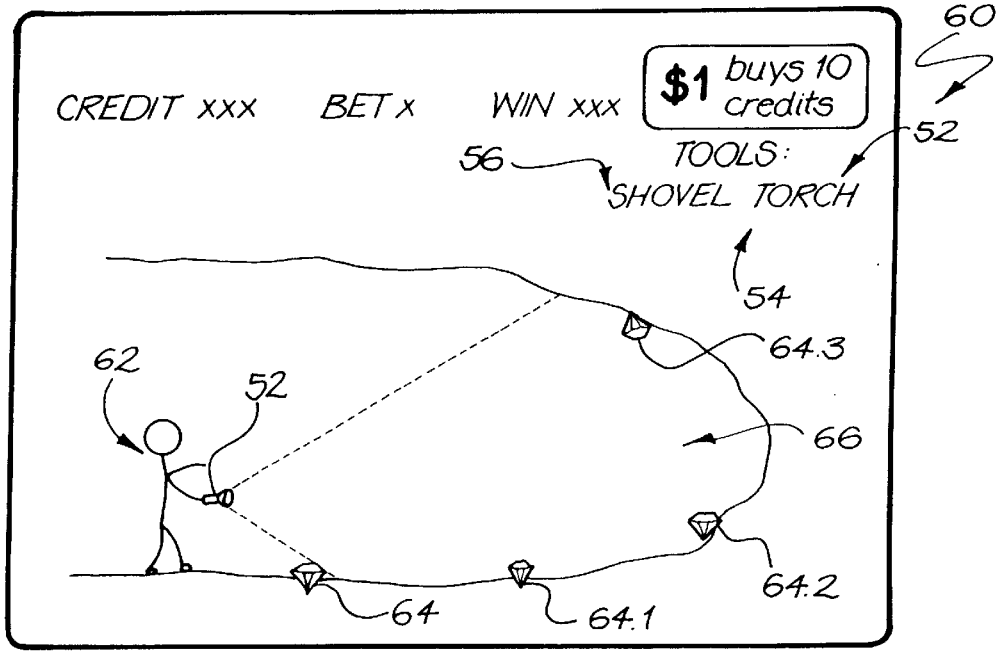
Figure 4C:
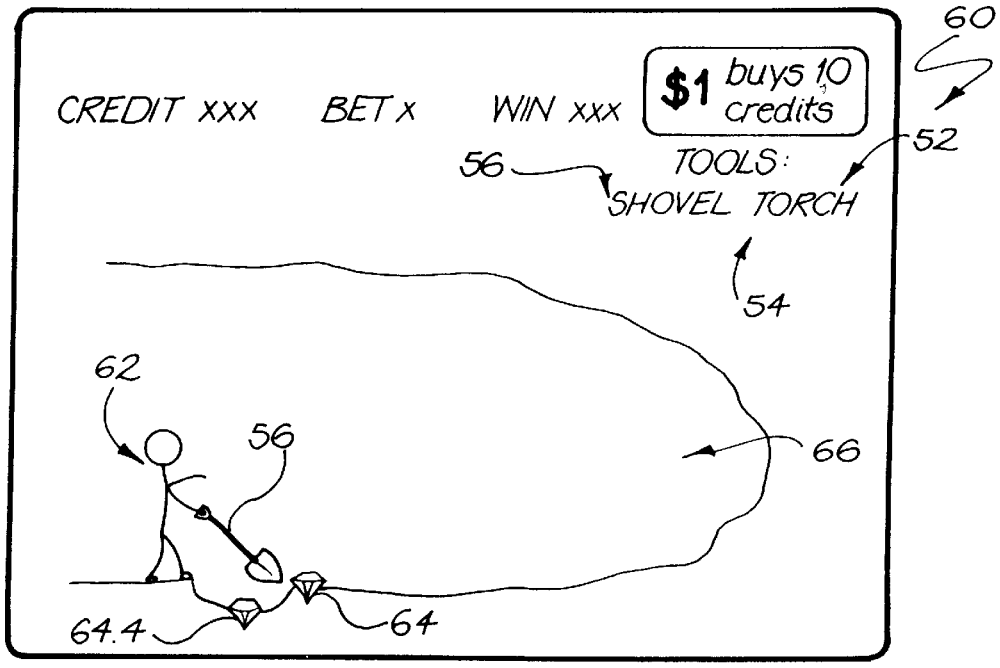

In the example illustrated in FIGS. 4*a* to 4*c* of the drawings, the second screen feature is a mining feature indicated by an initial screen display 60 in FIG. 4*a* of the drawings. The mining feature includes a character 62 trying to find gems 64 in a mine 66. Although only one gem 64 is illustrated initially in FIG. 4*a* of the drawings, it is assumed that more gems will be buried or hidden within the mine 66. By the character 62 "using" the Torch symbol 52 or the Shovel symbol 56 more gems 64 will be revealed.

Each gem 64 is worth a predetermined number of credits and the number of credits which each gem 64 is worth will be dependent on its colour, size or shape.

Initially, in FIG. 4*a* of the drawings the character 62 only has access to one gem 64. However, because the character 62 has use of the Torch symbol 52 and the Shovel symbol 56, the character 62 can gain access to more gems 64 in the mine 66.

Hence, as shown in FIG. 4*b* of the drawings by using the Torch symbol 52, the character 62 illuminates additional gems 64.1, 64.2 and 64.3, each of which is worth a predetermined number of credits.

Then, by the character 62 using the Shovel symbol 56, access is gained to at least one further gem as shown in FIG. 4*c* of the drawings. Accordingly, by the character 62 "digging" with the Shovel 56, a further gem 64.4 is also revealed.

It is to be noted that, from the subset of the special aid symbols, if the player had only a Matches symbol and not the Torch symbol 52 the character would have been able to light a Match to see a little further into the mine 66 but not as far as the Torch symbol 52. Accordingly, fewer gems 64 would have been revealed.

Also, if the player had had the Pickaxe symbol instead of the Shovel symbol 56 the character 62 would have been able to dig deeper into the mine 66 possibly revealing more gems 64.

If the player had the Food symbol, the character 62 would have been able to stay in the feature for longer and therefore may have been able to venture further into the mine 66 to find more gems 64 or may have been able to go on to another second screen feature altogether.

Also, the prizes awarded for the gems 64 are dependent upon the aid symbols used by the player to find the gems 64. As an example, if two red gem symbols 64 are revealed when the Torch symbol 52 is used the player may get five credits. However, if two red gems are revealed using a Matches symbol the player may get 50 credits. If two red gems had been revealed without the use of any of the aid symbols the player may get one hundred credits.

Figure 5:
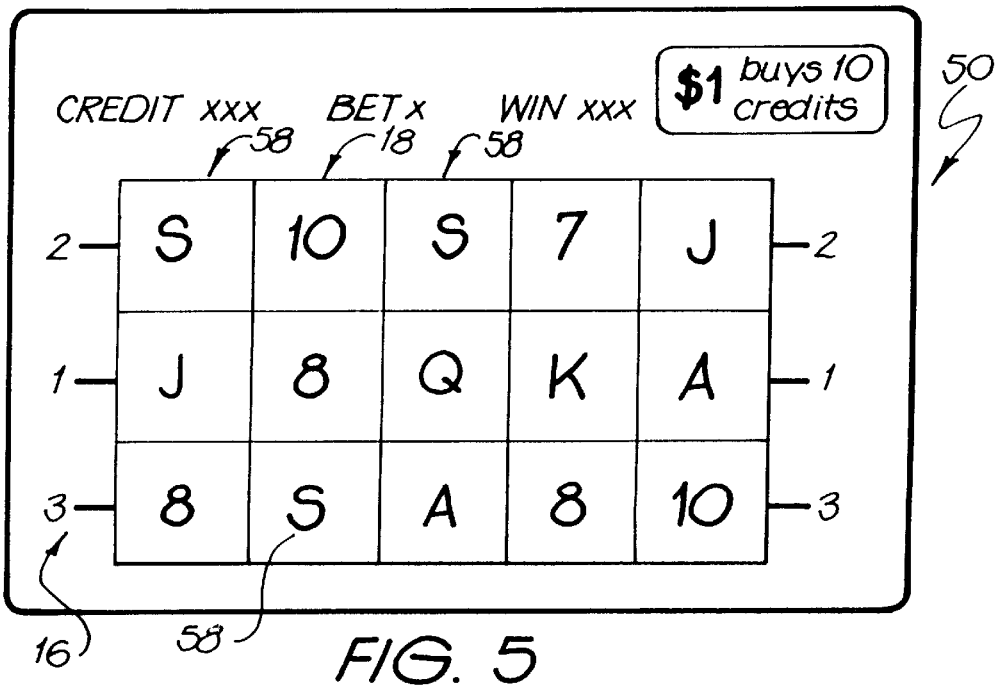
FIG. 5 shows a screen display of a base game, in accordance with a second embodiment of the invention, played on the gaming machine of FIG. 1.

Referring to FIGS. 5 and 6 of the drawings, a second embodiment of the invention is described. With reference to the previous drawings, like reference numerals referred to like parts, unless otherwise specified.

FIG. 5 shows the screen display 50 of a base game 16. It is to be noted that three Scatter symbols 58 have been spun up on the screen display 50 which is the trigger condition for commencement of a second screen feature.

In this embodiment of the invention, the reel strips of the base game 16 do not have any tools or aid symbols thereon. The aid symbols arise only during the feature and are chosen at that time.

Once the scatter symbols 58 have been spun up, the second screen feature is triggered.

Figure 6A:
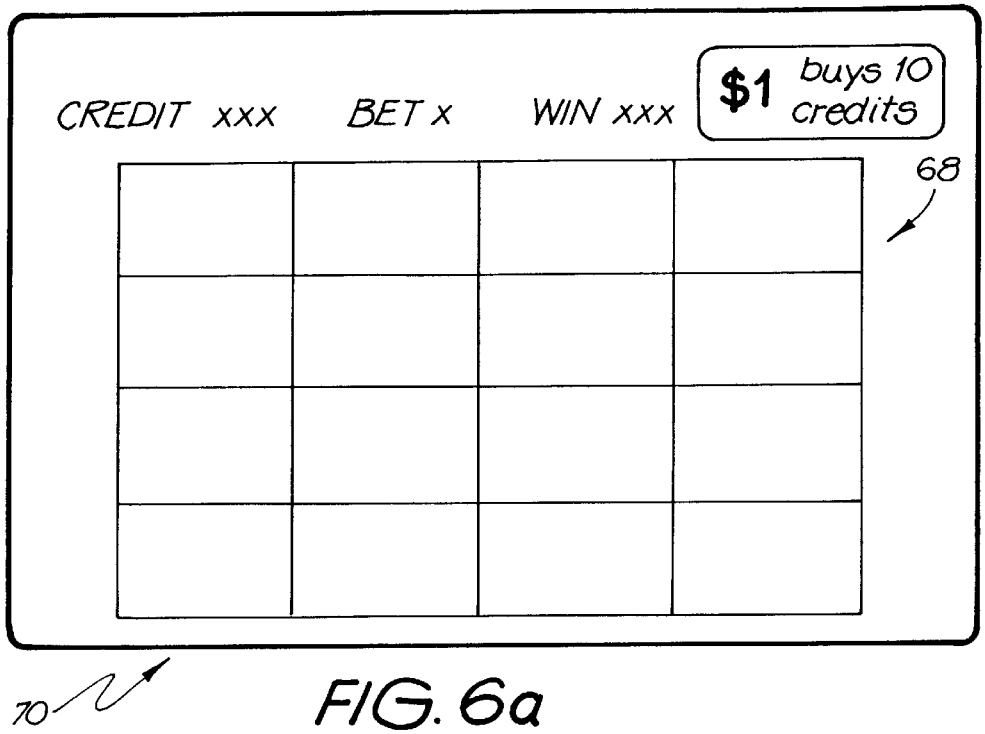
FIGS. 6*a* to 6*c* show a sequence of screen displays of a second screen feature following on from the game of FIG. 5.

An initial part of the second screen feature is the display of an array or matrix of sixteen boxes 68 on a second screen feature display 70 as shown in FIG. 6*a* of the drawings. Each box conceals an aid symbol. The aid symbols in this embodiment are a Rope symbol, a Torch symbol, a Shovel symbol, a Food symbol, a Pickaxe symbol, a Matches symbol, a Water symbol, a Compass symbol, a Knife symbol, a Backpack symbol, a Camera symbol, an Axe symbol, a Bucket symbol, a Map symbol, a Tent symbol and a Magnifying glass symbol.

Figure 6B:
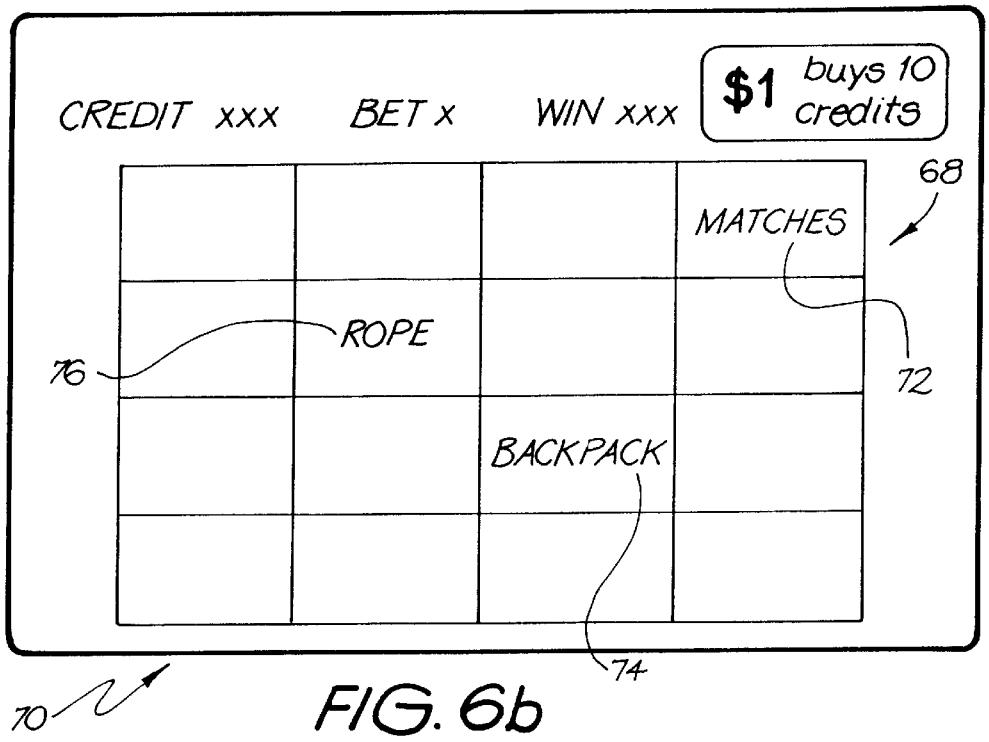

When the second screen feature is triggered, the player has the option to touch the screen overlying three of the boxes 68. The result is shown in FIG. 6*b* of the drawings where the Matches symbol 72, the Backpack symbol 74 and the Rope symbol 76 have been revealed by the player touching the appropriate boxes 68 of the screen 70.

Figure 6C:
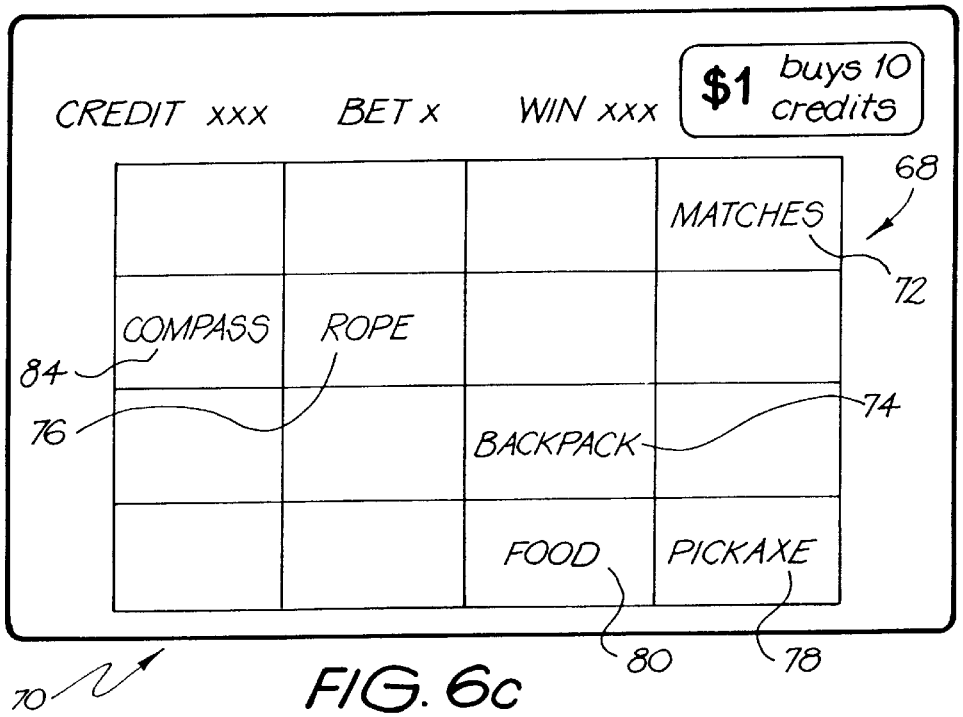

The purpose of the Backpack symbol 74 is to allow the character in the second screen feature to carry more "tools". Hence, because the Backpack symbol 74 has been revealed as one of the three chosen symbols, the player is allowed to choose an additional three aid symbols or tools to carry inside the Backpack. The result of this is as shown in FIG. 6*c* of the drawings where the Pickaxe symbol 78, the Food symbol 80 and the Compass symbol 84 have additionally been revealed.

After selection of the aid symbols, the second screen feature itself commences. The second screen feature is randomly chosen from a range of possible features with different scenarios. For example, the second screen feature may be the mining feature as described above with reference to FIG. 4 of the drawings.

It will be appreciated that different aid symbols are useful for different features and some may not be of use in the selected feature. For example, if the feature requires a character to cross a river then the Rope symbol 76 may be of help to swing across the river. It will be appreciated that the Compass 84 and the Pickaxe symbol 78 will be of no use. If, however, the selected feature is a maze then the Compass symbol 84 may be of use with the Pickaxe symbol 78 being of no use. If a player had selected the Map symbol (not shown) instead of the Compass symbol 84 then the player would have had more chance of navigating through the maze properly. In addition, if the player had had both the Compass symbol 84 and the Map symbol when entering the maze feature then that may be a guarantee of success in navigating through the maze.

The Food symbol 80 and the Water symbol (not shown) have the effect of lengthening the amount of time that the player remains in the feature. Accordingly, when the first feature completes the player will be allowed to take the same tools into a second. randomly selected feature.

Some aid symbols may be of use in more than one feature and in more than one way. For example, the water symbol may also be of use if a character needs to extinguish a fire in a feature.

As indicated above, some of the aid symbols may be combined with other aid symbols to give more meaningful effects. As described above, in the maze feature if the Compass and the Map are used a guarantee of success is obtained. Further, if the player has the Matches and the Axe symbol and the character is required to build a fire in the feature then the character may use the Axe to chop firewood for the fire and the Matches to light it. Additionally, if the player also had the Map symbol they may have guaranteed success in lighting the fire as the Map could be used for paper along with the firewood to make it easier to start the fire.

Figure 7:
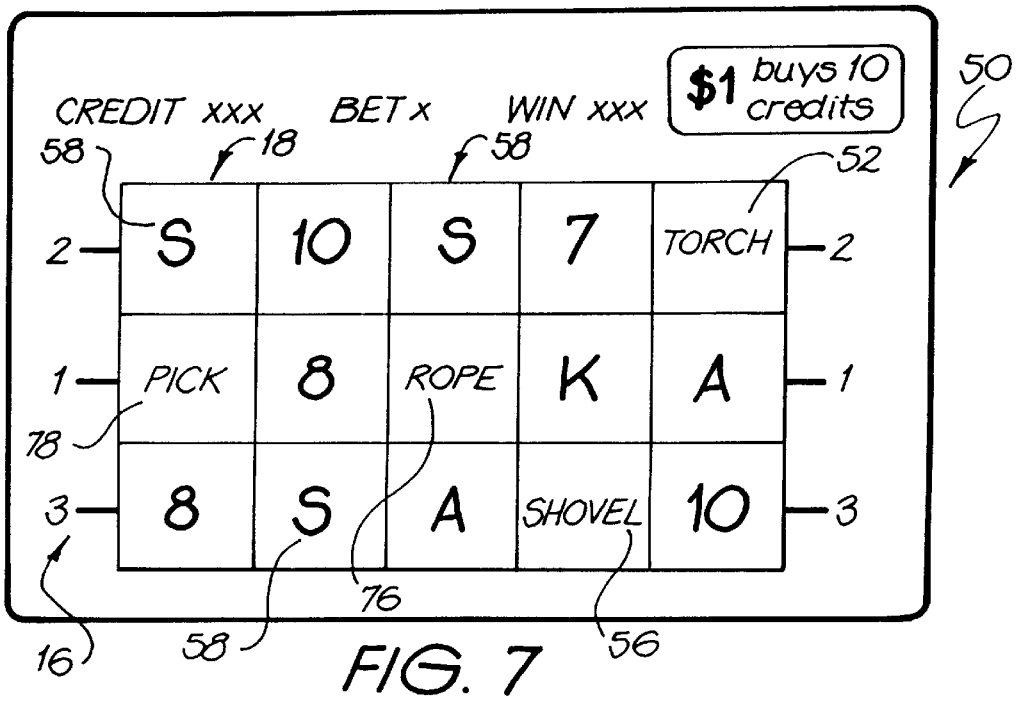
FIG. 7 shows a screen display of a base game, in accordance with a third embodiment of the invention, played on the gaming machine of FIG. 1.
Figure 8:
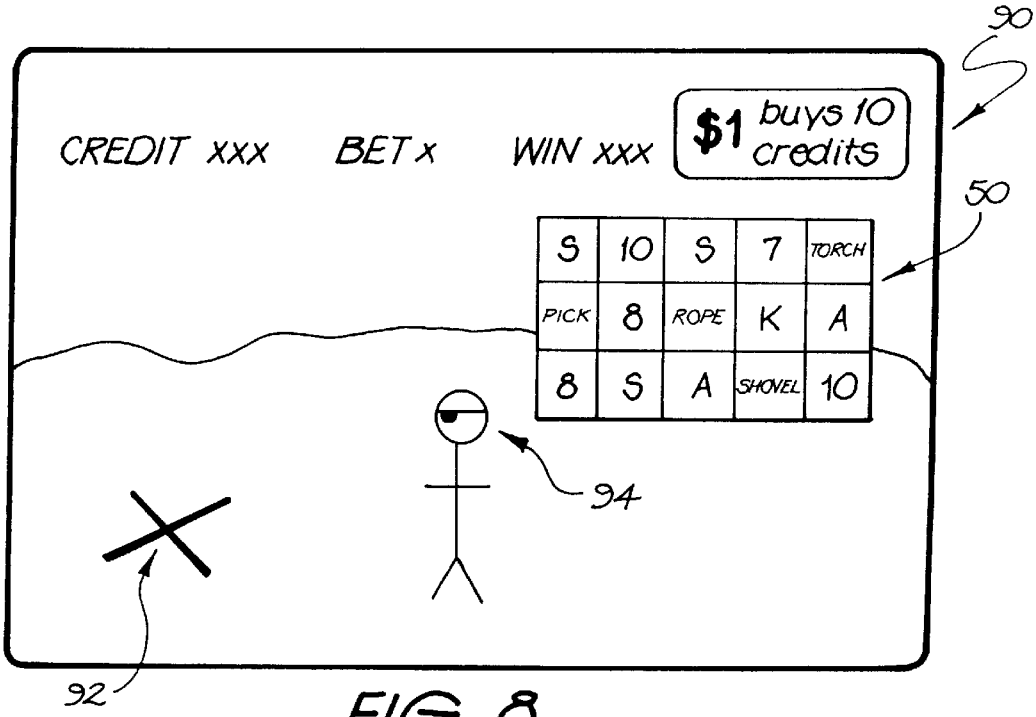
FIG. 8 shows a second screen feature following on from the base game of FIG. 7.

Referring to FIGS. 7 and 8 of the drawings, a third embodiment of a game played on the gaming machine 10 of FIG. 1 is illustrated. Once again, with reference to the previous drawings, like reference numerals refer to like parts, unless otherwise specified.

In this embodiment of the invention, the reel strips of the game 16 carry the aid symbols thereon. When three Scatter symbols 58 are spun up as shown in FIG. 7 of the drawings, a second screen feature is started. The screen display 50 of the base game 16 is incorporated into a screen display 90 of the second screen feature as described in the Applicant's co-pending Australian patent application no. 91437/01 (and corresponding New Zealand patent application no. 515697, South African patent application no. 20019712 and U.S. patent application Ser. No. 10/013594) which is incorporated herein by reference. This is one of a number of randomly selected second screen features from a range of possible second screen features.

In this example, the second screen feature is a pirate game where the pirate has to dig for buried treasure marked with a cross 92. A pirate character 94 has the aid symbols available to it which are contained in the screen display 50 of the initial base game 16. In the example illustrated the pirate character 94 will be able to "use" both the Pick 78 and the Shovel 56 to dig for the treasure. Thus, the pirate character 94 will have a greatly increased probability of getting a large prize at the end. An animation is shown of the pirate character 94 moving to the screen display 50 and removing the Pick 78 and the Shovel 56 from the screen display 50 and using them to dig for the treasure.

It is to be noted that, if the pirate character 94 had no useful tools on the screen display 50, the pirate character 94 would have to dig with his or her hands which results in a lower chance of revealing the treasure. However, if the treasure is revealed by the character 94 digging without the use of aid symbols, the value of the prize awarded may be higher than if tools had been used.

Referring finally to FIGS. 9 and 10 of the drawings, a further embodiment of the invention is illustrated. Once again, with reference to the previous drawings, like reference numerals refer to like parts, unless otherwise specified.

In this embodiment of the invention, a set of aid symbols is carried on the reels of the underlying base game 16. The game 16 is a five reel game with one aid symbol on each reel. In other words, reel 1 has a Torch symbol 52 on it, reel 2 has a Matches symbol 72, reel 3 has a Shovel symbol 54, reel 4 has a Rope symbol 76 and reel 5 has a Compass symbol 84. The aid symbols are accumulated every time they spin up. Once the player has three aid symbols collected, this serves as a trigger condition for the commencement of a second screen feature.

Figure 9A:
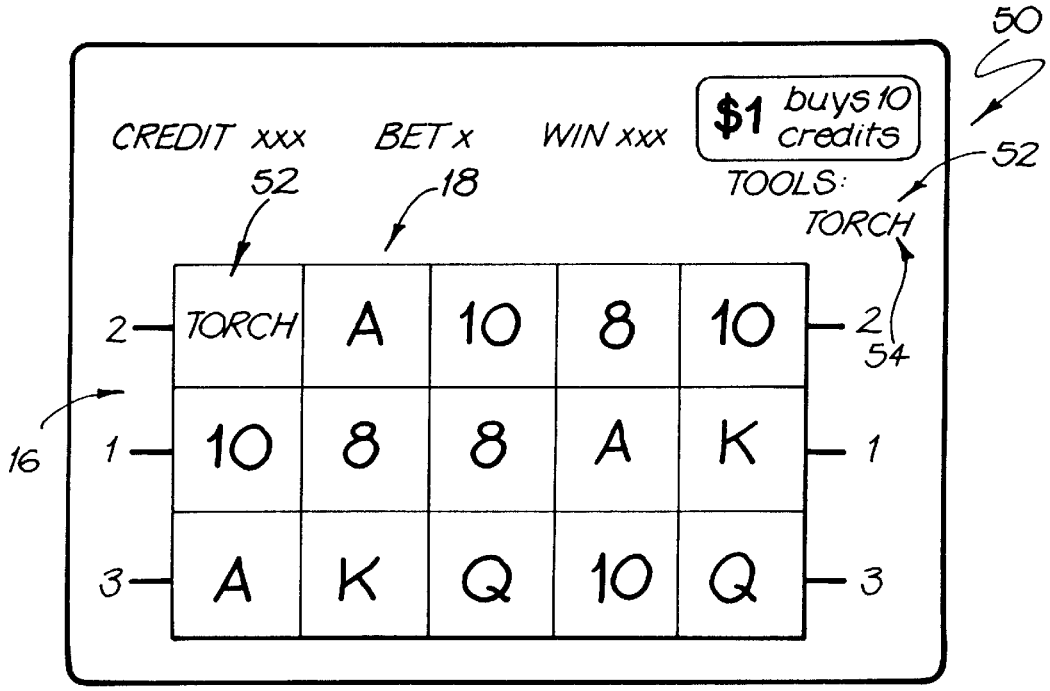
FIGS. 9*a* to 9*c* show screen displays of a base game, in accordance with a fourth embodiment of the invention, played on the gaming machine of FIG. 1.

Accordingly, as shown in FIG. 9*a* of the drawings the player initially collects the Torch symbol 52 which is spun up on reel 1.

Figure 9B:
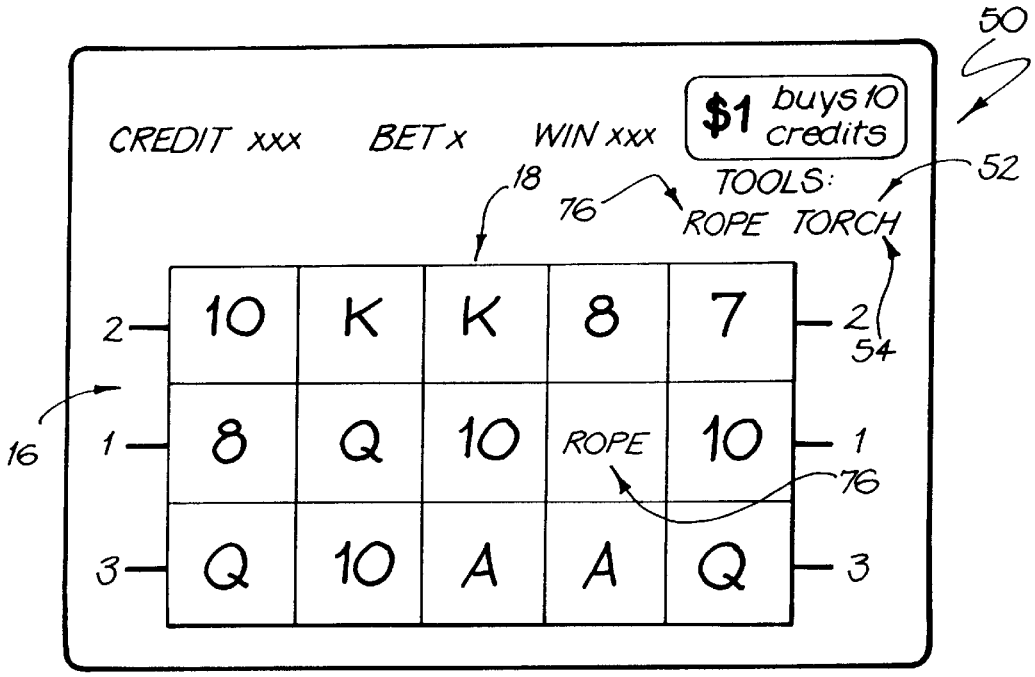
Figure 9C:
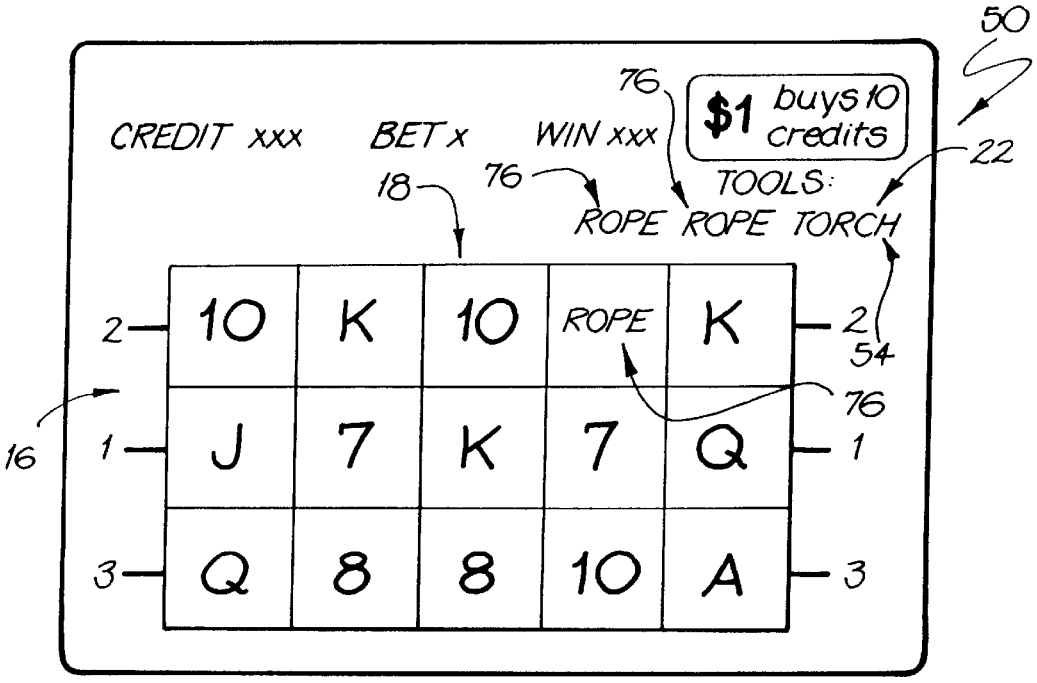

The Rope symbol 76 is subsequently spun up during the playing of the base game and this is collected at 54 as shown in FIG. 9*b* of the drawings. Subsequently, a further Rope symbol 76 is collected at 54 on the screen display 50 as shown in FIG. 9*c* of the drawings.

Figure 10A:
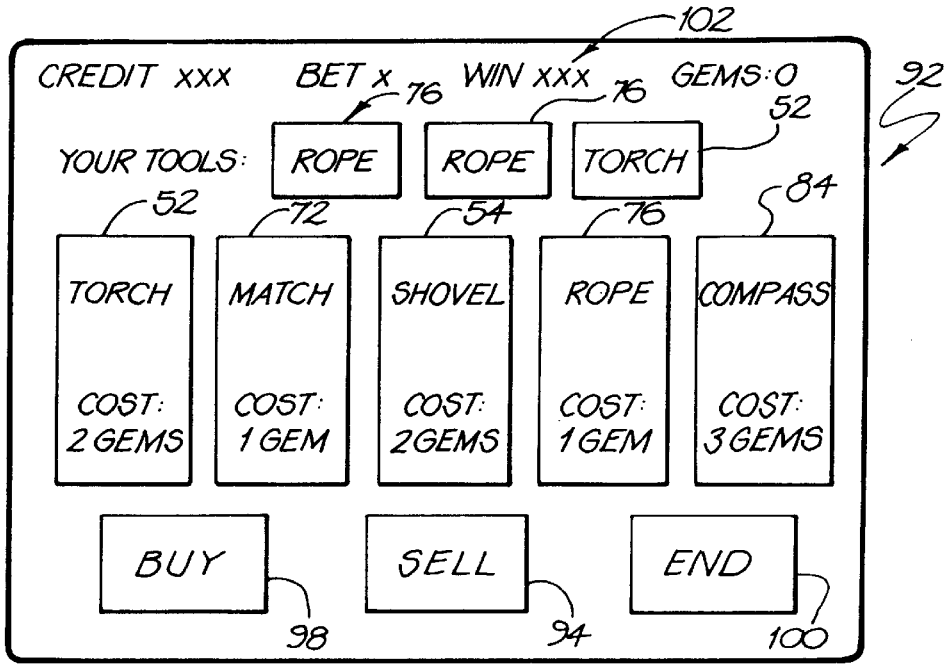
FIGS. 10*a* to 10*d* show various screen displays of an initial part of a second screen feature following the base game of FIG. 9.
Figure 10B:
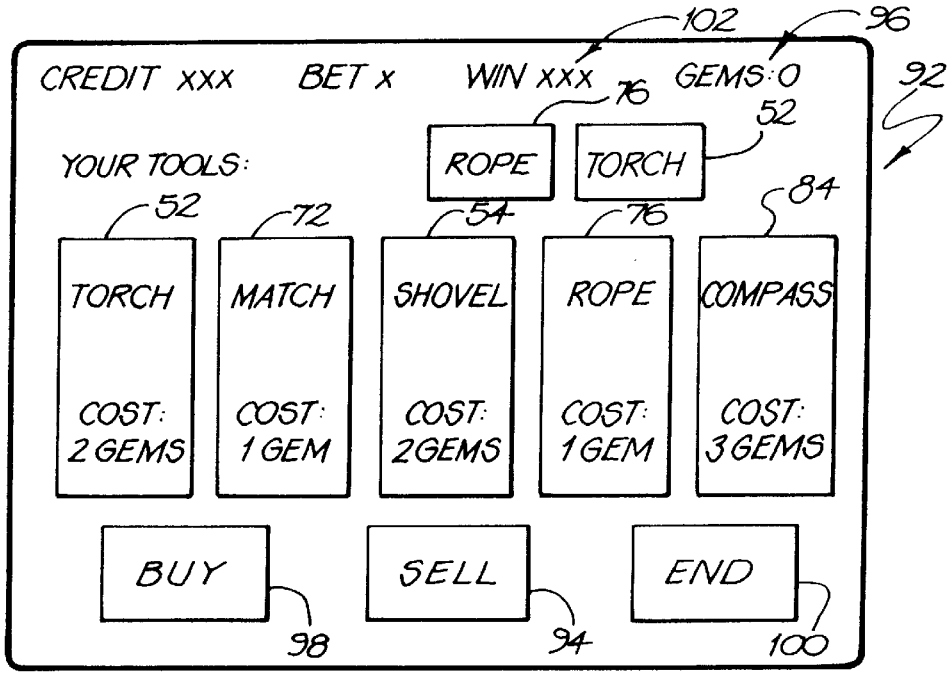

The collection of three tools serves as the trigger condition for the feature game. The feature game starts off with a trading screen 92 as shown in FIG. 10*a* of the drawings. The purpose of the trading screen 92 is to enable the player to buy or sell aid symbols. The aid symbols collected by the player are displayed on the trading screen 92. The player may decide to sell one of the Rope symbols 76 since the player has two of those. Accordingly, a "Sell" button 94 is pressed followed by one of the Rope symbols 76. This results in a credit of one gem being awarded as illustrated at 96 in FIG. 10*b* of the drawings. Each gem is worth ten credits.

The player can now use the credit of one gem to buy an aid symbol of the equivalent value. Thus, the player could use the credit of one gem to purchase the Match symbol. Instead, the player could sell another tool to get more gems or can end the trading session and cash in the one gem which the player has purchased.

Figure 10C:
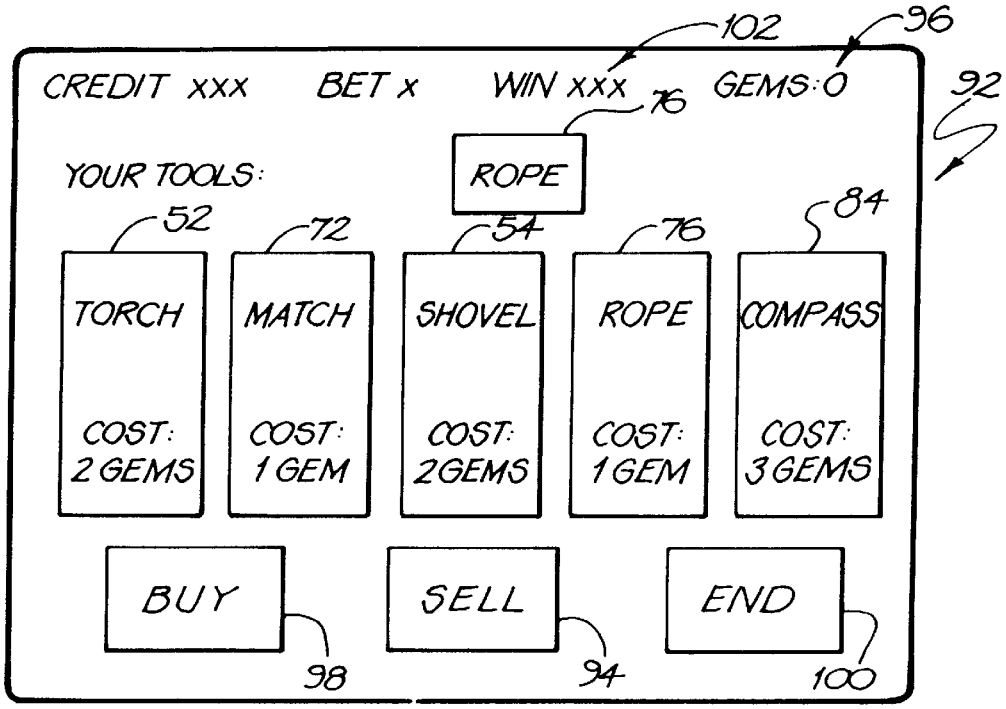

In the example shown, the player decides to sell the Torch symbol 52 by touching the sell button 94 and the Torch symbol 52 in the "Your Tools" section of the screen so that a further two gems are awarded for a total credit of three gems as shown in FIG. 10*c* of the drawings.

Figure 10D:
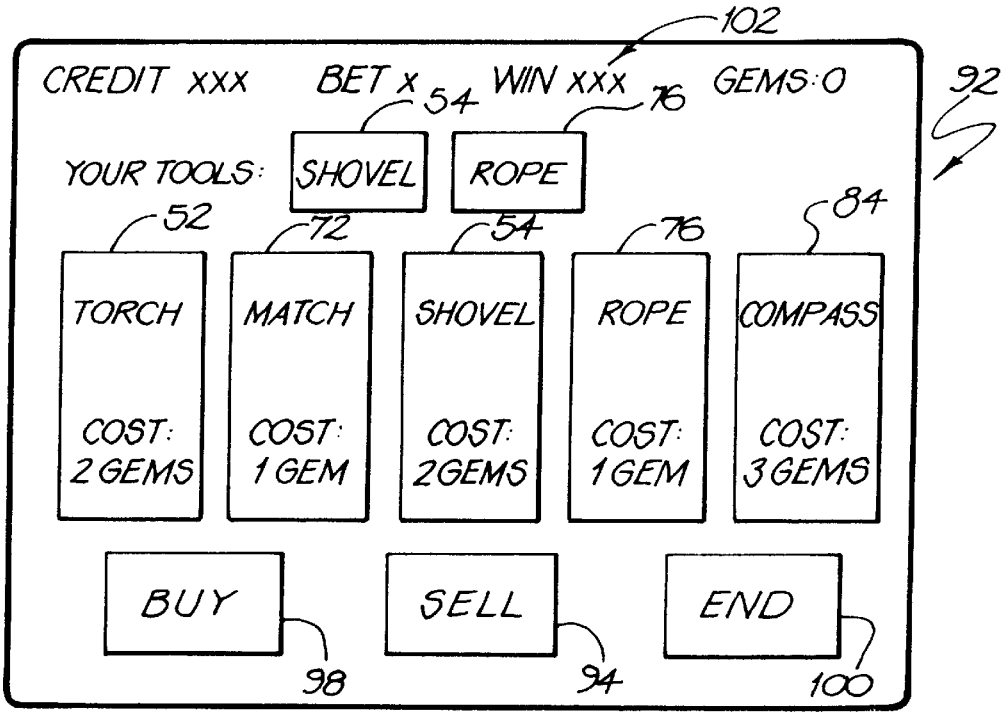

The player then decides to purchase the Shovel symbol 54. This is effected by the player pressing a "Buy" button 98 followed by the Shovel symbol 54. The Shovel 54 is then added to the "Your tools" section on the trading screen 92 as shown in FIG. 10*d* of the drawings.

The player decides to end the trading session by touching an "End" button 100 on the trading screen 92. As the player still had a credit of 1 gem in the trading section of the game, ten credits are added to a win meter 102 for the gem that was not used to buy aid symbols.

The player now has a Shovel and a Rope to use during the feature that follows. The feature which follows is randomly selected from a range of possible scenarios and it does not necessarily follow that the feature which the controller 44 selects will result in a benefit to the player from having selected the tools in the trading section of the game.

It is an advantage of the invention that a game is provided which will greatly enhance player interest due to more active involvement by the player. In addition, by skilful selection of aid symbol, where such selection by the player is permitted, higher rewards are potentially available to the player.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

We claim:

1. A gaming machine having a display means and a game control means arranged to control images displayed on the display means, the game control means being arranged to play a game wherein at least one random event is caused to be displayed on the display means and, if a predefined winning event occurs, the machine awards a prize, wherein the game played under the control of the control means includes symbols representative of aids (referred to below as "aid symbols"), each aid symbol having a particular function applicable to it, said aid symbols being applied in a subsequent feature following said game with an outcome of the feature being dependent on a feature scenario and the aid symbols applied to that scenario.

2. The gaming machine of claim 1 in which the game played under the control of the control means is a base game with the subsequent feature being a feature game.

3. The gaming machine of claim 2 in which the aid symbols are accumulated by the player during the base game, the aid symbols being used by the player in the subsequent feature.

4. The gaming machine of claim 1 in which accumulation of a predetermined number of the aid symbols during the game serves as a trigger condition for the subsequent feature.

5. The gaming machine of claim 1 in which various aid symbols are provided as a subset of symbols.

6. The gaming machine of claim 1 in which, after completion of the game, the subsequent feature commences during which the player uses the aid symbols that were accumulated during the game to improve the possibility of the player receiving a greater total monetary reward during the subsequent feature than would have been possible without the assistance of the aid symbols.

7. The gaming machine of claim 1 in which the game is a series of free games triggered from a preceding game.

8. The gaming machine of claim 7 in which, during the series of free games, the aid symbols are accumulated.

9. The gaming machine of claim 1 in which the game is a feature game during which at least one aid symbol is selected from a larger set of aid symbols.

10. The gaming machine of claim 9 in which the selected aid symbols are used during the subsequent feature.

11. The gaming machine of claim 10 in which the subsequent feature is a free game feature and the selected aid symbols interact with other symbols of games of the free game feature.

12. The gaming machine of claim 1 in which only those aid symbols that were displayed on the display means at the time when the feature commences are available during the feature.

13. The gaming machine of claim 1 in which the game played under the control of the control means includes impediment symbols which have a negative effect on the success of the player.

14. The gaming machine of claim 1 in which additional aid symbols are accumulated during the subsequent feature using aid symbols that have already been accumulated.

15. The gaming machine of claim 1 in which the player is given the option to exchange aid symbols for at least one of other aid symbols and credits.

16. The gaming machine of claim 1 in which prizes that are awarded during the subsequent feature employing the aid symbols are dependent upon the aid symbols that were used to reveal them.

17. The gaming machine of claim 16 in which the more difficult it is to reveal a prize, the higher the prize will be.

18. The gaming machine of claim 1 in which the selection of the aid symbols is randomly effected.

19. The gaming machine of claim 1 in which player choice is involved in selecting the aid symbols which the player wishes to use.

* * * * *